US009481381B2

(12) United States Patent
Levitt et al.

(10) Patent No.: US 9,481,381 B2
(45) Date of Patent: Nov. 1, 2016

(54) LIGHTWEIGHT YOKE FOR RAILWAY COUPLING

(71) Applicant: Pennsy Corporation, West Chester, PA (US)

(72) Inventors: Perry Levitt, West Chester, PA (US); Zachary Ryan Brook, Leola, PA (US); Manuel Tavares, Doylestown, PA (US); Wayne H. Murphy, Pottstown, PA (US); Aaron Stern, West Chester, PA (US)

(73) Assignee: PENNSY CORPORATION, West Chester, PA (US)

( * ) Notice: Subject to any disclaimer, the term of this patent is extended or adjusted under 35 U.S.C. 154(b) by 0 days.

(21) Appl. No.: 14/273,198

(22) Filed: May 8, 2014

(65) Prior Publication Data

US 2014/0360964 A1 Dec. 11, 2014

Related U.S. Application Data

(63) Continuation-in-part of application No. 13/678,021, filed on Nov. 15, 2012, now abandoned, and a continuation-in-part of application No. 13/678,203, filed on Nov. 15, 2012, now Pat. No. 9,038,836.

(51) Int. Cl.
*B61G 9/22* (2006.01)

(52) U.S. Cl.
CPC ..... *B61G 9/22* (2013.01)

(58) Field of Classification Search
CPC ..... B61G 7/00; B61G 7/10; B61G 7/12; B61G 9/00; B61G 9/04; B61G 9/20; B61G 9/22
USPC ..... 213/40 R, 47, 62 R, 67 R, 68, 69
See application file for complete search history.

(56) References Cited

U.S. PATENT DOCUMENTS

| | | | | |
|---|---|---|---|---|
| 2,088,135 | A | 7/1937 | Johnson et al. | |
| 4,024,958 | A | 5/1977 | Kaufhold | |
| 4,081,082 | A | 3/1978 | Scherrer et al. | |
| 4,206,849 | A | 6/1980 | Kaim | |
| 4,537,304 | A | 8/1985 | Kaim et al. | |
| 4,605,133 | A | 8/1986 | Altherr | |
| 5,096,076 | A * | 3/1992 | Elliott | B61G 9/20 213/67 A |

(Continued)

OTHER PUBLICATIONS

Brandenberg, Kristin; "Successfully Machining Austempered Ductile Iron (ADI)"; Applied Process Inc. Technologies Div.—Livonia, Michigan, USA; Oct. 2001.

(Continued)

*Primary Examiner* — R. J. McCarry, Jr.
(74) *Attorney, Agent, or Firm* — John F. A. Earley, III; Frank J. Bonini, Jr.; Harding, Earley, Follmer & Frailey, P.C.

(57) ABSTRACT

E-type and F-type yokes improve the ability of the yokes to be constructed having lighter weight yet function to handle loads from car coupling assembly components, such as, for example, a coupler mounted on the yoke. The E-type and F-type yokes have straps and openings provided in the straps, and are constructed from austempered ductile iron. Embodiments may be constructed with a tail or butt portion that includes sloped walls that form cavities in the butt portion of the yoke, where a supporting structure spans between the yoke rear wall and the draft gear seat wall.

27 Claims, 4 Drawing Sheets

(56) References Cited

U.S. PATENT DOCUMENTS

| | | | | |
|---|---|---|---|---|
| 5,320,229 | A * | 6/1994 | Mautino | B61G 9/20 213/67 A |
| 5,511,676 | A * | 4/1996 | Holmes | B61G 9/20 213/67 A |
| 5,582,307 | A | 12/1996 | Hawthorne et al. | |
| 5,878,897 | A * | 3/1999 | Lazzaro | B61G 3/06 213/139 |
| 5,900,082 | A | 5/1999 | Hewitt | |
| 6,796,448 | B1 | 9/2004 | Wilt et al. | |
| 7,926,672 | B2 * | 4/2011 | Ely | B61G 9/22 213/67 R |
| 8,607,998 | B2 | 12/2013 | McMillen et al. | |
| 2012/0248053 | A1 * | 10/2012 | McMillen | B61G 9/20 213/67 R |

OTHER PUBLICATIONS

A. Kahn and B.K. Chen, "Evaluation of Grade 1 Austempered Ductile Iron for Application to Rail Cast Components", Proceedings of the Fifth Asia Pacific Industrial Engineering and Management Systems Conference 2004.

Luís Magalhães, Jorge Seabra, "Teeth Surface Failures in Austempered Ductile Iron (ADI) Gears", Gears and Transmission Workshop, Paper No. XIII, p. 269-286, Faculdade de Engenharia da Universidade do Porto, Portugal, Jun. 5, 2003.

SY40AE Yoke Publication.

Y45AE Yoke Publication.

Stokes B. et al.; "Effects of Carbides on Fatigue Characteristics of Austempered Ductile Iron", Metallurgical and Materials Transactions A, 36 (2005) 977-988.

Bubenko et al.; "Fatigue Crack Propagation through Austempered Ductile Iron Microstructure"; Materials Engineering, vol. 17, 2010, No. 3, p. 15-20.

Bubenko et al.; "Fatigue Crack Propagation Within the Austempered Ductile Iron Microstructure"; Acta Metallurgica Slovaca, vol. 17, 2011, No. 1, p. 18-25.

Dundar, Sacit; "Application of Austempered Ductile Iron to Rail Wheel Sets"; Journal of Engineering Sciences 2003, 9 (3), p. 283-287.

International ADI and Simulation Conference; May 28-30, 1997.

SAIFoundry; "Austempered ductile iron production properties"; http://www.slideshare.net/SAIFoundry/austempered-ductile-iron-production-properties-applications#; Mar. 19, 2012.

* cited by examiner

LIGHTWEIGHT YOKE FOR RAILWAY COUPLING

BACKGROUND OF THE INVENTION

1. Field of the Invention

The present invention is directed to apparatus for coupling railway cars, and more particularly to E-type and F-type yokes that are constructed to be lighter in weight than current yokes and to provide improved wear resistance.

2. Description of Related Art

It is common practice in the railroad industry to use coupling components to secure adjacent rail cars together, in particular, freight cars. In general, two adjacent freight cars are joined by heavy shafts extending from each car, known as couplers. The couplers are installed on yokes that are mounted on the underside of the car. Railway couplers, particularly those utilized for railway freight cars or vehicles, have a coupler body which is an integral casting of a coupler head and a shank. The head of the shank may be an AAR Standard Type "E" or "F" Coupler Head. The head also carries a knuckle and includes a lock, a thrower, a pivot pin and an articulated lock assembly. Couplers generally carry a knuckle which is pivotally mounted on the coupler head and is designed to engage with another knuckle carried on an adjacent coupler or another car.

The coupler is made from a casting formed from low alloy steel. Although there are AAR standards for couplers, the length of the shank from the butt end of the coupler to the location where the shank joins the head may vary. The coupler is designed to be installed on a draft yoke of a railway vehicle. In the case of the type F coupler shank, the butt end of the coupler shank is a spherical surface and bears against the face of the front follower plate mounted within the yoke. The coupler is pivotally mounted on a yoke with a pin that joins the coupler to the vehicle's yoke. Generally, each coupler is engaged with a yoke housing a shock-absorbing element referred to as the draft gear. The type-E and type-F couplers are the standard couplers for railway freight cars. As a result of implementation of AAR standards and specifications for production of couplers, such as a type-E coupler, the standard railway car couplers are completely interchangeable, regardless of the manufacturer. In addition, adherence to a standard also promotes uniformity among manufacturers products, so that couplers from any one manufacturer are to able to be readily joined to couplers from any other domestic manufacturer. The Association of American Railroads ("AAR") has adopted standards for railway couplers, which provide specific geometry and dimensions that allow the coupler to receive standard knuckles that are pivotally carried on the coupler to couple with a knuckle on a coupler of an adjacent railway car. The knuckle must be allowed to freely operate when coupling and uncoupling railway cars. In order to determine whether a coupler meets the AAR standards, gauges may be used, which are applied to the coupler to verify that the coupler dimensions or parameters are within an allowable variation or tolerance range.

Each coupler is engaged with a yoke housing a shock-absorbing element referred to as the draft gear. Conventionally, the yoke is an elongated structure having two side sections extending from and joined by a tail portion. The side sections are also known and referred to as "straps". The side sections or straps are joined at the opposite end by a head portion where the yoke is joined to the coupler with a securing component, such as a key or pin. The yoke generally has a pocket formed by the straps and a rear wall, and a draft gear is positioned between the straps of the yoke, and between the tail portion and the head portion. The best-known yokes are the E-type and F-type. The E-type yoke is governed by AAR standards that include the AAR S-143 Standard, SY 40AE, Y40 or YS93AE, for a 24⅝ inch gear pocket, although there are some tolerances that the pocket may have, as permitted by the standards. A typical E-type yoke has straps that are 5 inches. The F-type yoke is governed by the S-149 standard and the Y45 standard. Although there are other differences between E-type and F-type yokes, a primary difference is the design and orientation of the pin or key used to join the coupler to the yoke.

Typical yokes contain apertures in the yoke head portion, which also may be known as the key slots or pin bores by which a coupler is joined to the yoke with the installation of a key or pin through the slot or bore to connect the yoke and coupler. Adjacent railcars, when coupled together and in motion, place tension on the yoke and compressive forces are transferred to bearing surfaces at opposed ends of the yoke where the draft gear is housed.

Adjacent freight cars are separated in accordance with standard specifications which includes an allowance for a specified yoke length. In accordance with applicable AAR standards, typically, E-type and F-type yokes, respectively, may have a length of 41⅛" or 37½".

SUMMARY OF THE INVENTION

Lightweight E-type and F-type yokes are provided. The yokes of the invention improve the ability of the yokes to be constructed having lighter weight, yet function to handle loads from car coupling assembly components, such as, for example, a coupler mounted on a yoke. Yokes according to the invention, in addition to being constructed lighter in weight, may also have improved wear properties, such as, for example, in regard to the engaging surfaces of the yoke.

According to one preferred embodiment, E-type and F-type yokes are provided having a tail or butt portion that includes angles or sloped walls that form a one or more cavities in the butt portion of the yoke.

According to another preferred embodiment, the butt portion of the yoke includes a supporting structure that features a transverse rib or wall that may be less than 2 inches, and preferably an inch or less, and more preferably less than ½ inch. According to some preferred embodiments, the supporting structure is even narrower, and is a transverse rib or wall that has a thickness of about ¼ inch.

It is another object of the invention to provide an improved yoke that includes lightening features of apertures in the straps or side walls of the yoke, or combinations thereof.

It is another object of the invention to provide an improved yoke that includes lightening features of apertures in the head of the yoke, and particularly in the top and bottom walls of the head.

It is another object of the invention to provide an improved yoke that may conserve material used to construct the yoke. In accordance with some preferred embodiments, yokes may be have maximum wall thicknesses of about 1¼ inches. According to some embodiments, some walls or ribs used in the construction of the yoke may have thicknesses as narrow as ¼ inch. In accordance with some preferred embodiments, the keyslot walls may be provided having a uniform or substantially uniform thickness that may be less than the thickness of the straps of the yoke. According to a preferred embodiment, a preferred thickness of the keyslot walls may be about 1¼ inches, and according to a most preferred embodiment, may be less, and may be about 1 inch.

It is another object of the invention to provide an E-type yoke that is lighter in weight than traditional E-type yokes, yet is suitably strong and meets or exceeds AAR standards for E-type yokes.

It is another object of the invention to provide a type-F yoke that is lightweight and has improved resistance to wear.

It is another object of the invention to provide an F-type yoke that is lighter in weight than traditional F-type yokes, yet is suitably strong and meets or exceeds AAR standards for F-type yokes.

According to one preferred embodiment, it is a further object of the invention to produce an E-type yoke with opposing keyslot walls having a uniform thickness in their extension beyond the head top and bottom walls.

It is another object to accomplish the above objects by providing a yoke with one or more of the above features, including embodiments that contain one or more or combinations of one or more of the features.

DETAILED DESCRIPTION OF THE PREFERRED EMBODIMENTS

Referring to FIGS. 1-10, exemplary embodiments of a lightweight coupler yoke 10,110 are shown. The yokes 10,110 are configured to be compatible with existing standard type couplers and knuckles to allow for use of the yokes 10,110 in current railway coupling applications. The yokes 10,110 preferably are constructed from austempered metal, as discussed herein, and preferably may be constructed having a suitable wall thicknesses to provide suitable strength to withstand force loads that a yoke would encounter during operations, including when in use on a railway vehicle. Preferred embodiments of the yokes also possess suitable strength properties to meet AAR standards or exceed them. The yokes 10,110 may be configured as a casting. In operation, the yokes 10,110 may be installed on a center sill of a railway vehicle along with a coupler and a draft gear (not shown).

Figure 4:
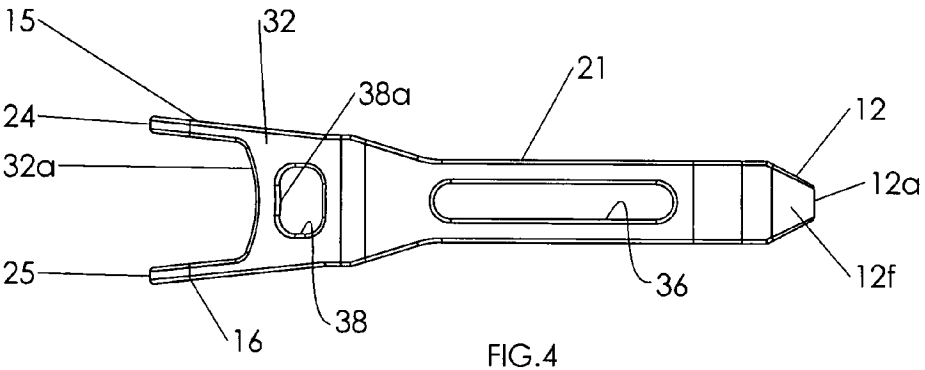
FIG. 4 is top plan view of the E-type yoke of FIG. 1, looking overhead at the yoke.
Figure 1:
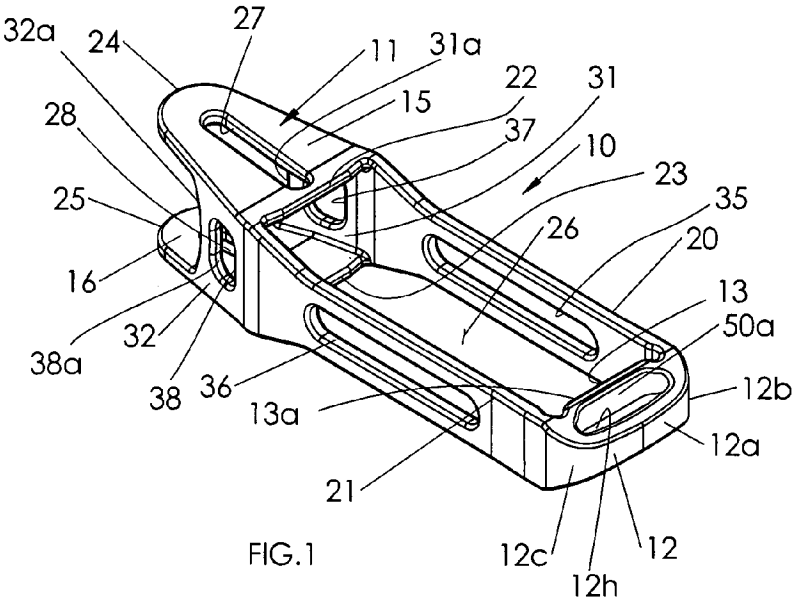
FIG. 1 is a perspective view of an E-type yoke according to the invention.
Figure 5:
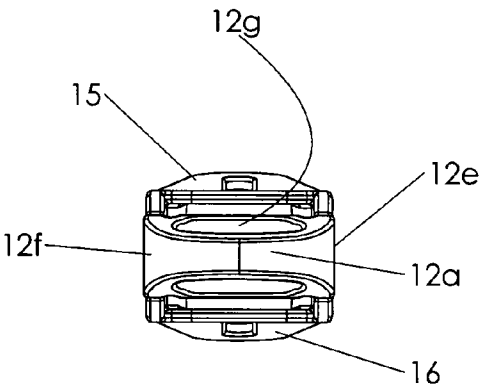
FIG. 5 is a rear elevation view of the yoke of FIG. 1, shown with the yoke resting on a side.
Figure 2:
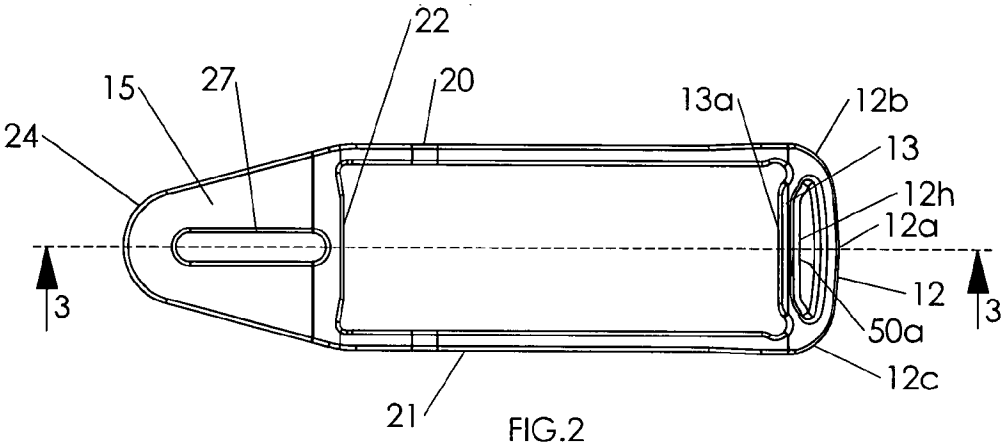
FIG. 2 is a side elevation view of the E-type yoke of FIG. 1, depicted in an orientation in which the yoke is used in operation.
Figure 3:
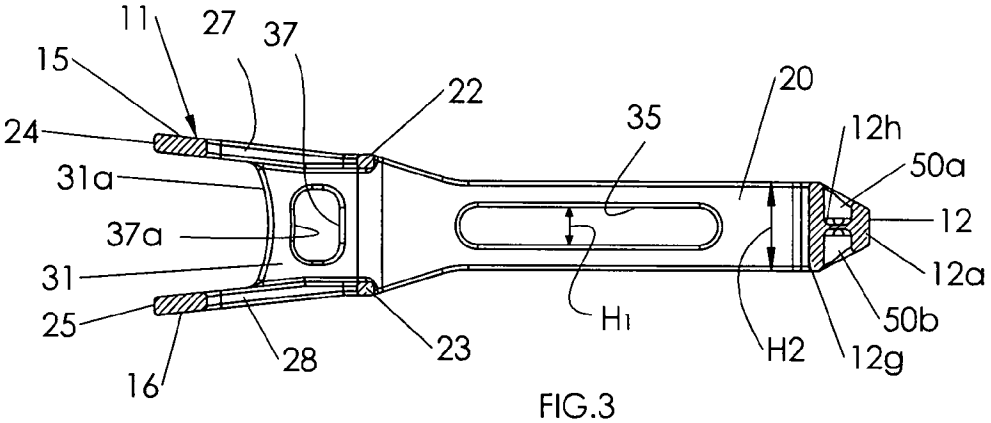
FIG. 3 is view looking from the bottom toward the top of a section of the yoke of FIG. 2, taken along the section line 3-3 of FIG. 2.

According to FIGS. 1-5 an E-type yoke 10 is shown according to a preferred embodiment. The yoke 10 has a head 11 at one end thereof and a butt portion 12 at the other end thereof. Connected to the butt end portion 12 are top and bottom straps 20,21, respectively, which span to extend to the yoke head 11. A draft gear seat 13 is shown having a substantially planar surface 13*a*. The yoke head 11 includes keyslot walls 15,16 which, in the embodiment illustrated, are outwardly divergent from one another. The keyslot walls 15,16 span from the front draft gear walls 22,23 from which they extend forwardly, to the nose portion 24,25. The draft gear pocket 26 is shown defined between the rear draft gear wall face 13*a*, the top and bottom straps 20,21, respectively, and the front draft gear walls 22,23. The keyslot walls 15,16 are provided with keyslots 27,28, respectively, which oppose each other, as shown in FIGS. 2, 3 and 5. Each keyslot 27,28 preferably has a radiused configuration at each end thereof. In addition to the keyslot walls 15,16, the head 11 also is shown having a first wall and a second wall, which may be referred to as a top wall 31 and a bottom wall 32.

The yoke 10 may be configured with standard yoke contour dimensions for E-Type couplers (such as Y40 and Y41). According to preferred configurations, according to one exemplary embodiment, a yoke configured with the Y40 yoke dimension preferably has a draft gear pocket length of 24⅝ inches, and for a Y41 yoke configuration, the draft gear pocket length is 36 inch long. According to preferred embodiments, the draft gear pocket 26 preferably is sized and dimensioned in accordance with AAR specifications and standards to accommodate a draft gear and/or other components that may be installed for the coupling assembly. According to a preferred embodiment, the E-type yoke may have a preferred length of 41⅛.

According to a preferred embodiment illustrated, openings 35,36 are provided in the respective straps 20,21. The openings 35,36 in the straps 20,21 preferably oppose each other. According to a preferred embodiment, the openings 35,36 are elongated to span across the straps 20,21. The openings 35,36 are shown having radiused ends and a straight elongated portion. The straps 20,21 may be constructed in accordance with an AAR standard, which in some preferred embodiments is 5 inches in height. The openings 35,36 are preferably provided within the 5 inches of strap height. According to a preferred embodiment, the height H1 of the openings 35,36 preferably are up to about one half of the strap height H2, as depicted according to a preferred embodiment shown in FIG. 3. According to one preferred embodiment, the strap height H2 is 5 inches and the opening height H1 is 2½ inches. According to one embodiment, the draft gear pocket 26 may be 25 inches (measured from a plane of the rear surface 13*a* to a plane of the draft gear pocket front walls 22,23). According to one preferred embodiment, the openings 35,36 are provided at a central location of the straps 20,21, relative to the strap height. According to one embodiment, the openings preferably are provided to be located within about 1.5 inches from the edge of a strap wall.

Referring to FIGS. 1, 3 and 4, the top wall 31 and bottom wall 32 of the head portion or head 11 preferably have wall openings 37,38, respectively, disposed therein. According to a preferred embodiment, the wall openings 37,38 are provided to oppose each other, and preferably, the openings 37,38 are centrally located in the top and bottom walls 31,32, respectively. According to a preferred embodiment, the top wall 31 and bottom wall 32 have a curved or radiused edges 31*a*,32*a*, respectively, which are provided at the front wall end. According to a preferred embodiment, the openings 37,38 preferably are provided with a forward portion 37*a*,38*a*, which is radiused or curved. According to some preferred embodiments, the radiused or curved forward portion 37*a*,38*a* of the respective top and bottom wall openings 37,38 has a profile corresponding with the radius or curve of the top and bottom front wall edges 31*a*,32*a*. In a preferred embodiment, the wall openings 37,38 have radiused or curved corners. As illustrated the top and bottom walls 31,32, respectively, support the yoke 10 and the keyslot walls 15,16 connecting to the respective top and bottom walls 31,32.

According to a preferred embodiment, the thickness of the yoke walls preferably may be constructed to be from about 1¼ inches to about ¼ inch. For example, the thickness of the walls forming the straps 20,21 may be from about 1 inch to 1¼ inch, with a preferred thickness of about 1⅛ inch. According to some embodiments, the top and bottom walls 31,32 of the head portion 11 may have a wall thickness that is similar to the walls of the straps 20,21. Preferably the thickness of the keyslot walls 15,16 may be provided to be about 1¼ inches or less, and according to some preferred embodiments, the thickness of the keyslot walls 15,16 is about 1 inch. According to a preferred embodiment, the wall thicknesses of the key slot walls 15,16, the straps 20,21 and top and bottom walls 31,32 may be from about 1 inch to 1¼ inches, wherein each wall or strap pair may have a thickness within this range, which may be a different thickness than the other wall pair or strap pair. According to a preferred embodiment, each strap 20,21 preferably may have a uniform thickness along its length between joining locations (which is shown joining with the butt end 12 at one end thereof, where a radiused fillet may be provided (FIG. 2), and joining with the head 11 at the other end thereof, which also may have a radiused fillet at the head portion 11.

According to a preferred embodiment, as illustrated, the yoke 10 has a butt end portion 12 disposed opposite the head portion 11. The butt end portion 12 is shown having radiused or curved edges 12*b*,12*c*, and a pair of pockets 50*a*,50*b* (see FIG. 3) provided in the butt end portion 12. Referring to FIG. 5, the butt end portion 12 is shown having tapered side wall portions 12*e*,12*f* which taper inwardly toward the center of the butt end portion 12. The butt end portion 12 is shown with a rear wall portion 12*a* formed by the narrowing of the converging side wall portions 12*e*,12*f*. Referring to FIG. 3, the butt end portion 12 is shown having an inner wall portion 12*g* which preferably is connected with the rear wall portion 12*a*. According to a preferred embodiment, the inner wall portion 12*g* connects with the rear wall portion 12*a* by a connecting structure, which in the preferred embodiment illustrated, is shown as a rib or wall 12*h*. The connecting rib or wall 12*h* preferably is transversely disposed and is provided at the mid level of the height of the butt end portion 12, such as, for example, the height of the inner wall 12*g*. The inner wall 12*g* according to some preferred embodiments may be formed from the wall that forms the draft gear seat 13 and may be coextensive with it, or formed such that the draft gear surface 13*a* is on one side of the wall and the rear surface of the draft gear seat wall faces into the cavities or pockets 50*a*,50*b*.

Figure 6:
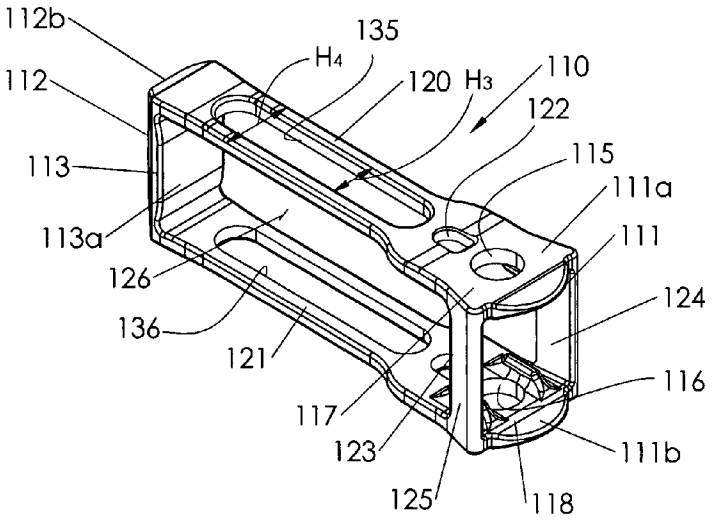
FIG. 6 is a perspective view of an F-Type yoke according to the invention.

Referring to FIGS. 6-10, according to one embodiment, an F-type coupler yoke 110 is shown according to a preferred embodiment. The coupler yoke in the F-type yoke configuration, illustrated as the yoke 110, is generally oriented vertically when in use, as depicted in the view of FIG. 6, where the pin bores 115,116 are shown located vertically to receive a connecting member, such as a pin (not shown) to connect with a component of a coupling assembly (e.g., a coupler). The yoke 110 has a head or head portion 111 at one end thereof and a butt portion 112 at the other end thereof. The head portion 111 preferably includes an upper head portion 111*a* and lower head portion 111*b*. Connected to the butt end portion 112 are top and bottom straps 120,121, respectively, which span to extend to the yoke head 111. A draft gear seat 113 is shown having a substantially planar surface 113*a*. The yoke head 111 includes pin bores 115,116 which are provided in the respective top and bottom walls 117,118 of the head 111. According to a preferred embodiment illustrated, the top and bottom walls 117,118 may be outwardly divergent from one another. Preferably, an upper window 122 and lower window 123 are formed in the respective top and bottom walls 117,118 through which observation of the draft gear (not shown) may be made when the yoke is installed in an assembly with other coupling components. A front supporting structure, shown including a pair of side walls 124,125 is provided, and connects the upper front wall portion or wall 117 with the lower front wall portion or wall 118. A pocket 126 is shown provided between the draft wall surface 113*a* and the yoke head portion 111.

Figure 7:
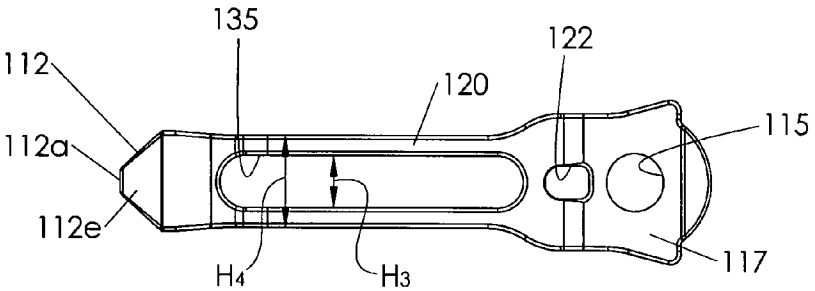
FIG. 7 is a top plan view of the yoke of FIG. 6.

According to a preferred embodiment illustrated, strap openings 135,136 are provided in the respective straps 120,121. The strap openings 135,136 preferably oppose each other. According to a preferred embodiment, the strap openings 135,136 are elongated to span across the straps 120,121. The strap openings 135,136 are shown having radiused ends and a straight elongated portion. The straps 120,121 may be constructed in accordance with an AAR standard, which in some preferred embodiments is 5¾ inches in height (as viewed in FIG. 7, where a strap height H4 is represented). The strap openings 135,136 are preferably provided within the 5¾ inches of strap height dimension H4. According to a preferred embodiment, the height H3 of a strap opening 135,136 preferably is up to about one half of the strap height H4, as depicted according to a preferred embodiment shown in FIG. 7, showing the strap 135. According to one embodiment, yoke 110 may have an overall length of 37½ inches, with the draft gear pocket 126 having a length of 24⅝ inches (measured from the rear surface 113*a* to a point 4 17/32 inches behind the center point of the pin or pin bore 115,116). According to a preferred embodiment, the rear surface 113*a* to the center of a pin bore 115,116 is 29 5/32 inches. According to one preferred embodiment, the strap openings 135,136 are provided at a location between the butt end portion 112 and the head portion 111. According to one embodiment, the openings preferably are provided to be located within about 1 inch to 1½ inches, and preferably about 1¼ inches to 1⅜ inches from the edge of a strap wall. According to a preferred embodiment, the straps 120,121 may increase in width at the locations near each of the ends of the respective straps 120,121, including, for example, at the strap locations where the front and rear of the openings 135,136 begin or end.

Figure 10:
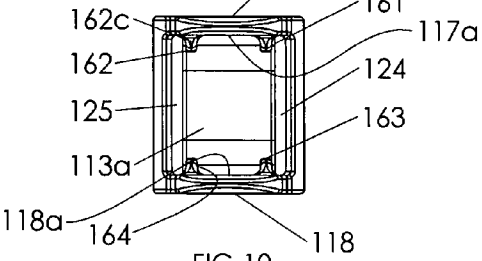
FIG. 10 is a front elevation view of the yoke of FIG. 6.
Figure 8:
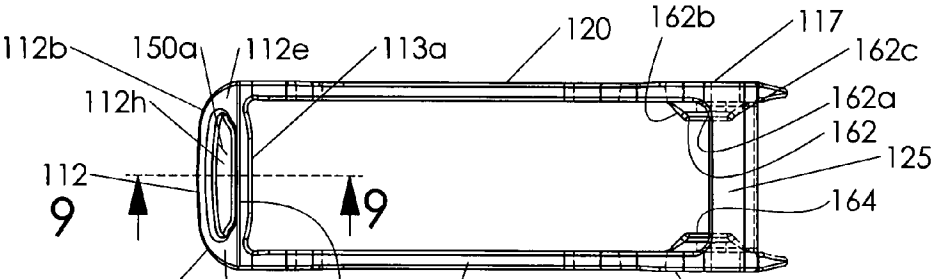
FIG. 8 is a right side elevation view of the yoke of FIG. 6.

According to a preferred embodiment, the thickness of the walls of the yoke 110 preferably may be constructed to have thicknesses between about 1¼ inches to about ¼ inch. For example, the thickness of the walls forming the straps 120,121 may be from about 1 inch to 1¼ inches, with a preferred thickness of about 1⅛ inches. According to some embodiments, the top and bottom walls 117,118 of the head portion 111 may have a wall thickness that is similar to the walls of the straps 120,121. The top and bottom walls 117,118 may comprise extensions of the respective straps 120,121 and have similar thicknesses or, alternatively, have different thicknesses than the respective straps 120,121. Accordingly, the pin bores 115,116 preferably have a depth corresponding with the thickness of the respective top and bottom wall 115,116, or respective top or bottom strap 120,121. According to a preferred embodiment a positioning feature is provided at the yoke head portion 111. Referring to FIG. 10, the positioning feature is shown in accordance with a preferred construction as a plurality of positioning tabs 161,162 provided on the inner surface 117*a* of the top wall portion 117, and positioning tabs 163,164 provided on the inner surface 118*a* of the lower wall 118. The positioning feature facilitates even loading to control and distribute loads, for example, from a coupler shank. The positioning tabs 161,162,163,164 preferably comprise wear surfaces and preferably are constructed from the same composition as the other portions of the yoke 110. Preferably the positioning tabs, such as the upper tabs 161,162 and lower tabs 163,164, are provided in opposing relation to each other so that the upper tabs 161,162 face the lower tabs 163,164, with each upper tab 162,162, facing a respective lower tab 163,164. As shown in FIG. 8, the tab 162 has a generally flat or substantially flat inner surface portion 162*a* and has tapered sides 162*b*,162*c*. Preferably, the other tabs 161,163,164 also are constructed having a flat or substantially flat inner surface portion and tapered sides. The tabs 161,162,163,164 narrow the opening provided at the head 111 of the yoke 110. According to one preferred embodiment, the tab pairs 161, 162 and 163,164 are disposed proximate the respective pin bore openings 115,116, with each tab of a pair being provided on an adjacent side of a respective pin bore 115,116.

Figure 9:
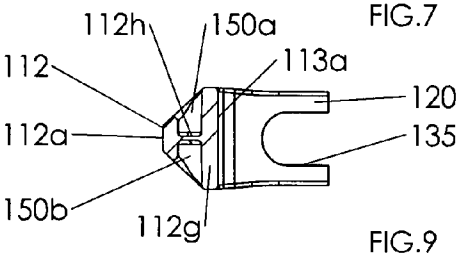
FIG. 9 is a sectional view of the butt end portion of the yoke of FIG. 6, broken away from the other portions of the yoke, and taken along the section line 9-9 of FIG. 8.

According to a preferred embodiment, as illustrated, the yoke 110 has a butt end portion 112 disposed opposite the head portion 111. The butt portion 112 is shown having radiused or curved edges 112*b*,112*c*, and pockets 150*a*,150*b* provided in the butt end portion 112. According to preferred embodiments, the pocket arrangement includes a first pocket 150*a* and second pocket 150*b*. Referring to FIGS. 7, 8 and 9, the butt end portion 112 is shown having tapered side wall portions 112*e*,112*f* which taper inwardly toward the center of the butt end portion 112 (similar to the walls 12*e*,12*f* of the butt end portion 12 shown in FIG. 5, in connection with the yoke 10). The butt end portion 112 is shown with a rear wall portion 112*a* formed by the narrowing of the converging side wall portions 112*e*,112*f*. Referring to FIG. 9, the butt end portion 112 is shown having an inner wall portion 112*g* which preferably is connected with the rear wall portion 112*a*. According to a preferred embodiment, the inner wall portion 112*g* connects with the rear wall portion 112*a* by a connecting structure, which in the preferred embodiment illustrated, is shown as a rib or wall 112*h*. The connecting rib or wall 112*h* preferably is transversely disposed and is provided at the mid level of the height of the butt end portion 112, such as, for example, the height of the inner wall 112*g*. The inner wall 112*g* according to some preferred embodiments may be formed from or be part of the wall that forms the draft gear seat 113 and may be coextensive with it, or formed such that the draft gear surface 113*a* is on one side of the wall and the rear surface thereof faces into the cavities or pockets 150*a*,150*b*.

According to a preferred embodiment, the front portion of the straps 120,121 may be constructed to slightly taper inwardly at the head portion 111. According to a preferred embodiment, the inwardly taper of the straps 120,121 preferably is after the front of the openings 135,136, and the straps 120,121 and head walls 117,118 that join with straps 120,121, respectively, also may have an inward taper. According to a preferred embodiment, a further inward taper of the front portions of the walls 117,118 may be provided, and the inward taper may include a portion of converging wall thickness in the front of each wall 117,118, preferably at each front flange 117*b*,118*b*.

According to some embodiments, the yoke 110 may be configured with standard yoke contour dimensions for F-Type yokes. According to preferred configurations, a yoke configured with the S-149 yoke dimension preferably has a draft gear pocket length of 24⅝ inches and a length of 37½ inches. The spacing between the straps 120,121, as depicted in FIG. 8, preferably, meets or exceeds the AAR standards (including any allowable tolerances) so the pocket 126 formed between the straps 120,121 may accommodate coupling components (e.g., a draft gear). According to some preferred embodiments, the yoke height, as shown by reference to the orientation in FIG. 8, may have a height of about 11½ inches. The yoke 110 preferably may be configured with dimensions that meet the AAR specifications for F-type yokes including with any permitted tolerances, and, may exceed the specifications.

According to a preferred embodiment, the yokes 10,110 are constructed from an austempered metal, and more preferably, from austempered ductile iron (ADI). Although other austempered metals may be used, and other grades of ADI, according to a preferred embodiment, yokes may be constructed from Grade 3 ADI. According to a preferred embodiment, the ADI may be Grade 3 ADI in accordance with ASTM A897/A897M for ADI castings. According to some preferred embodiments, yokes 10,110 may have properties that meet or exceed the specifications for Grade 3 ADI.

The yokes 10,110 preferably join with a coupler that carries a pivotally connected knuckle movable between open and closed positions. According to preferred embodiments, the yokes 10,110 are constructed from an austempered metal, and more preferably austempered ductile iron. As discussed herein, according to preferred embodiments, the yokes 10,110 are constructed from ductile iron that is austempered (austempered ductile iron or "ADI"). According to a preferred embodiment, the yokes 10,110 may be constructed from a material that is suitably strong and, according to preferred embodiments, may be used to construct a yoke 10,110 which meets or exceeds AAR standards. According to come embodiments, the yokes 10,110 may be constructed from Grade E steel or ductile iron, and according to some preferred embodiments, the yokes 10,110 may be constructed from an austempered metal, such as for example, austempered steel, austempered alloy steel, as well as other austempered metals, and austempered metal alloys. According to a preferred embodiment, the yokes 10,110 are constructed from austempered ductile iron. The ductile iron from which the yoke 10,110 is formed, may include austempered ductile iron that comprises ductile iron alloyed with one or more metals selected from the group consisting of nickel, molybdenum, manganese, copper and mixtures thereof. According to preferred embodiments, the metal, such as, for example, according to a preferred embodiment, ductile iron used to produce the yoke 10,110, may be treated by a treatment process, and preferably a process to strengthen the material, and to provide a suitable microstructure in the formed yoke 10,110. According to preferred embodiments, the treatment process preferably involves an austenitizing process, by which the formed yoke 10,110 is an austempered material, and more preferably, austempered ductile iron (ADI). For example, the forming of the yoke 10,110 may involve applying a suitable austenitizing process to the formed ductile iron yoke, (e.g., a casting, forging, machining or other method of forming the yoke). One preferred method involves heating the yoke casting in a heat extraction composition, such as, for example, a molten salt bath, to austenitizing temperature; and holding the bath at an austenitizing temperature so as to dissolve carbon in austenite, followed by quenching (preferably rapidly done) to avoid pearlite formation, and holding the yoke at an austempering temperature in the molten salt bath. The isothermal transformation to ausferrite preferably takes place to provide an austempered ductile iron yoke 10,110. According to alternate embodiments, austempered ductile iron (ADI) may include ductile iron alloyed with one or more metals, such as, for example, nickel, molybdenum, manganese, copper and mixtures thereof.

The ADI or ductile iron is austempered to obtain tensile strength, yield, and elongation properties for the inventive yokes which are suitable to meet or exceed the AAR standards for yokes utilized in coupling systems, including the current standard set forth by the American Association of Railroads (AAR) in AAR Manual of Standards and Recommended Practices, such as current standard M-211, M-205, M-220 NDT and Rule 88 of the AAR Office Manual, the complete contents of which are herein incorporated by reference. Alternatively, according to some alternate embodiments, austempered steel, such as, austempered alloy steel, as well as other austempered metals, such as, for example, austempered metal alloys, may be used to construct the yokes 10,110.

According to preferred embodiments, the yokes 10,110 may be constructed having wall thicknesses that are reduced compared to current existing yokes. The yokes 10 and 110 shown are preferred embodiments, and other configurations, preferably, yoke constructions meeting the standard geometries of AAR coupler yoke standards may be provided and produced in accordance with the present invention, including constructing the yoke to be lighter in weight and/or have thinner walls or wall portions, having openings in the straps and walls, as well as constructing the yokes from austempered metal, and more preferably Grade 3 ADI. Preferred thicknesses for the yoke walls according to preferred embodiments, are from about ¼ inch to about 1¼ inches.

Lightweight yokes according to the invention preferably are compatible with coupling and usage of the prior yokes for connection with and use with prior and existing standard AAR couplers, draft gears, blocks and other standard coupling assembly components. The lightweight yokes of the invention provide a lightweight alternative that may be used in place of prior yokes, wherever the prior yokes have been used or are called for. In addition, although references are made to some preferred dimensions corresponding with AAR standards, the dimensions preferably include tolerances provides by or permitted by the standards. According to alternate embodiments, the yokes may be dimensioned to meet one or more alternative standards.

According to preferred embodiments, the coupler yokes may be made from a casting and with the use of cores.

It is intended that the foregoing detailed description be regarded as illustrative rather than limiting, and that it be understood that it is the following claims, including all equivalents, that are intended to define the spirit and scope of this invention. Numerous other changes, substitutions, variations, alterations and modifications may be ascertained by those skilled in the art and it is intended that the present invention encompass all such changes, substitutions, variations, alterations and modifications as falling within the spirit and scope of the appended claims.

What is claimed is:

1. A railway vehicle coupler yoke, comprising:

(a) a head portion at one end having a first wall and a second wall defining a front opening therebetween;

(b) a rear portion;

(c) two elongated strap portions, the strap portions spanning from the head portion to the rear portion, said rear portion joining said strap portions; and (d) a central pocket with two open sides formed by said two elongated strap portions;

(e) wherein each strap portion has at least one opening therein, (f) wherein said at least one opening in each said strap portion is disposed at a location between said head portion and said rear portion; and (g) wherein each strap portion includes at least a bordering portion that borders the central pocket, and where the opening in each strap portion is located in the strap bordering portion.

2. The railway vehicle coupler yoke of claim 1, wherein each said opening provided in one strap portion opposes the opening provided in the other strap portion.

3. The railway vehicle coupler yoke of claim 1, wherein said yoke is constructed from austempered metal.

4. The railway vehicle coupler yoke of claim 3, wherein said austempered metal is austempered ductile iron.

5. The railway vehicle coupler yoke of claim 4, wherein said austempered ductile iron comprises ductile iron alloyed with one or more metals selected from the group consisting of nickel, molybdenum, manganese, copper and mixtures thereof.

6. The railway vehicle coupler yoke of claim 4, wherein said coupler yoke is configured as an E-type coupler yoke.

7. The railway vehicle coupler yoke of claim 6, wherein said first wall and said second wall defining said front opening comprise keyslot walls, and wherein the yoke head portion includes a top wall and a bottom wall disposed in opposing relation to each other, wherein said top wall is joined at one side thereof with one of said elongated strap portions, and wherein said bottom wall is joined at one side thereof with the other of said elongated strap portions, wherein the end of said top wall and said bottom wall opposite the end thereof joined with a said strap each has an edge forming a front edge of said yoke; wherein an opening is provided in said top wall, wherein an opening is provided in said bottom wall, and wherein said top and bottom wall openings are oppositely disposed.

8. The railway vehicle coupler yoke of claim 7, wherein said edge of said top wall and said edge of said bottom wall are arcuately disposed, and wherein each of said head top wall and head bottom wall openings has at least one edge thereof that is arcuately shaped and corresponds with the profile of the arcuately shaped head top wall edge and arcuately shaped head bottom wall edge, and wherein each said head top wall and head bottom wall opening is spaced apart from its respective top wall edge and bottom wall edge.

9. The railway vehicle coupler yoke of claim 7, wherein a draft gear seat wall is provided at the rear of said central pocket, wherein said rear portion comprises a butt end having a tapered wall portion joining with each strap, wherein said tapered wall portions converge as they extend rearwardly to the back end of the yoke and form a rear wall of the yoke, wherein a cavity is formed by said tapered wall portions and said draft gear seat wall, and wherein a connecting structure transversely spans between said draft gear seat wall and said yoke rear wall.

10. The railway vehicle coupler yoke of claim 4, wherein said coupler yoke is configured as an F-type coupler yoke.

11. The railway vehicle coupler yoke of claim 10, wherein a draft gear seat wall is provided at the rear of said central pocket, wherein said rear portion comprises a butt end having a tapered wall portion on each side thereof joining with each strap, wherein said tapered wall portions converge as they extend rearwardly to the back end of the yoke and form a rear wall of the yoke, wherein a cavity is formed by said tapered wall portions and said draft gear seat wall, and wherein a connecting structure transversely spans between said draft gear seat wall and said yoke rear wall.

12. The railway vehicle coupler yoke of claim 11, said first wall having an interior and an exterior, said second wall having an interior and an exterior, wherein at least one positioning tab is disposed on the interior of each of said first wall and said second wall, said at least one positioning tab on said first wall opposing the at least one positioning tab on said second wall, said positioning tabs extending from each said respective first wall interior and second wall interior into the front opening.

13. The railway vehicle coupler yoke of claim 12, including a first pin bore disposed in the first wall and a second pin bore disposed in the second wall, said pin bores opposing one another, and wherein said positioning tabs comprise a first pair of positioning tabs disposed on the first wall interior on opposite sides of said first pin bore and a second pair of positioning tabs disposed on the second wall interior on opposite sides of said second pin bore.

14. The railway vehicle coupler yoke of claim 12, including a first pin bore disposed in the first wall and a second pin bore disposed in the second wall, said pin bores opposing one another, and wherein said positioning tabs comprise a first pair of positioning tabs disposed on opposite sides of said first pin bore and a second pair of positioning tabs disposed on opposite sides of said second pin bore.

15. The railway vehicle coupler yoke of claim 10, wherein said head portion first wall is continuous with said top strap portion and forms an extension thereof, wherein said head portion second wall is continuous with said bottom strap portion and forms an extension thereof, wherein a pair of vertical walls join said first wall and said second wall at each side of said front opening, said first wall having an interior and an exterior, said second wall having an interior and an exterior, wherein at least one positioning tab is disposed on the interior of said first wall, wherein at least one positioning tab is disposed on the interior of said second wall, said at least one positioning tab on said first wall opposing said at least one positioning tab on said second wall, said positioning tabs extending from each respective first wall interior and second wall interior into the front opening.

16. The railway vehicle coupler yoke of claim 1, wherein said elongated strap portions have thicknesses from 1.0 to 1.25 inches.

17. The railway vehicle coupler yoke of claim 1, wherein the central pocket has a front and a rear, wherein a draft gear seat rear wall is located at the rear of the central pocket, and wherein a front draft gear wall is located at the front of the central pocket, wherein said openings are disposed on opposite sides of the central pocket formed by said strap portions, and wherein said openings are disposed in the portion of the strap portion that is located between the front draft gear wall and the rear draft gear wall.

18. The railway vehicle coupler yoke of claim 17, wherein at least a portion of each strap portion is located between the front draft gear wall and the rear draft gear wall.

19. The railway vehicle coupler yoke of claim 1, wherein said coupler yoke is configured as an F-type coupler yoke;

wherein said head portion first wall is continuous with said top strap portion and forms an extension thereof, wherein said head portion second wall is continuous with said bottom strap portion and forms an extension thereof, wherein a pair of vertical walls join said first wall and said second wall at each side of said front opening;

wherein said head portion first wall is wider than said elongated top strap portion, and wherein said head portion second wall is wider than said elongated bottom strap portion, and wherein the opening in the top strap portion is located in an area of said top strap portion that is narrower than said head portion first wall, and wherein the opening in the bottom strap portion is located in an area of said bottom strap portion that is narrower than said head portion second wall.

20. A railway vehicle coupler yoke, comprising:

(a) a head portion at one end having a first wall and a second wall defining a front opening therebetween;

(b) a rear portion;

(c) two elongated strap portions, the strap portions spanning from the head portion to the rear portion, said rear portion joining said strap portions;

(d) a central pocket with two open sides formed by said two elongated strap portions;

(e) wherein each strap portion has at least one opening therein, and wherein each said opening provided in one strap portion opposes the opening provided in the other strap portion;

(f) wherein said yoke is constructed from austempered ductile iron;

(g) wherein said coupler yoke is configured as an E-type coupler yoke;

(h) wherein said first wall and said second wall defining said front opening comprise keyslot walls, (i) wherein the yoke head portion includes a top wall and a bottom wall disposed in opposing relation to each other, wherein said top wall is joined at one side thereof with one of said elongated strap portions, wherein said bottom wall is joined at one side thereof with the other of said elongated strap portions, wherein the end of said top wall and said bottom wall opposite the end thereof joined with a said strap portion each has an edge forming a front edge of said yoke; wherein an opening is provided in said top wall, wherein an opening is provided in said bottom wall, and wherein said top and bottom wall openings are oppositely disposed;

(j) wherein said edge of said top wall and said edge of said bottom wall are arcuately disposed, and wherein each of said openings has at least one edge thereof that is arcuately shaped and corresponds with the profile of the arcuately shaped wall edge, and wherein each said opening is spaced apart from one of said top wall edge and said bottom wall edge;

(k) wherein a draft gear seat wall is provided at the rear of said central pocket, wherein said rear portion comprises a butt end having a tapered wall portion on each side thereof joining with each strap, wherein said tapered wall portions converge as they extend rearwardly to the back end of the yoke and form a rear wall of the yoke, wherein a cavity is formed by said tapered wall portions and said draft gear seat wall, and wherein a connecting structure transversely spans between said draft gear seat wall and said yoke rear wall;

(l) wherein a front draft gear wall is provided at the front of said central pocket;

(m) wherein each said opening in the strap portion is provided at a location of the strap portion between the draft gear seat wall and the front draft gear wall; and (n) wherein said elongated strap portions have thicknesses from 1.0 to 1.25 inches.

21. A railway vehicle coupler yoke, comprising:

(a) a head portion at one end having a first wall and a second wall defining a front opening therebetween;

(b) a rear portion;

(c) two elongated strap portions, the strap portions spanning from the head portion to the rear portion, said rear portion joining said strap portions; and (d) a central pocket with two open sides formed by said two elongated strap portions;

(e) wherein each strap portion has at least one opening therein, and wherein each said opening provided in one strap portion opposes the opening provided in the other strap portion;

(f) wherein said yoke is constructed from austempered ductile iron;

(g) wherein said yoke is configured as an F-type coupler yoke;

(h) wherein a draft gear seat wall is provided at the rear of said central pocket, wherein said rear portion comprises a butt end having a tapered wall portion on each side thereof joining with each strap, wherein said tapered wall portions converge as they extend rearwardly to the back end of the yoke and form a rear wall of the yoke, wherein a cavity is formed by said tapered wall portions and said draft gear seat wall, and wherein a connecting structure transversely spans between said draft gear seat wall and said yoke rear wall dividing said cavity into a first cavity and a second cavity;

(i) wherein said head portion first wall is continuous with said top strap portion and forms an extension thereof, wherein said head portion second wall is continuous with said bottom strap portion and forms an extension thereof, wherein a pair of vertical walls are spaced apart and located on opposite sides of said front opening and join said first wall and said second wall at each side of said front opening;

(j) wherein each said elongated strap portion has a narrow portion, and wherein said strap portion opening is provided in said strap narrow portion;

(k) wherein said first wall has an interior and an exterior, wherein said second wall has an interior and an exterior, wherein at least one positioning tab is disposed on the interior of each of said first wall and said second wall, said at least one positioning tab on said first wall opposing the at least one positioning tab on said second wall, said positioning tabs extending from each said respective first wall interior and second wall interior into the front opening;

(l) a first pin bore disposed in said first wall and a second pin bore disposed in said second wall, said pin bores opposing one another, and wherein said positioning tabs comprise a first pair of positioning tabs disposed on the first wall interior on opposite sides of said first pin bore and a second pair of positioning tabs disposed on the second wall interior on opposite sides of said second pin bore; and (m) wherein said elongated strap portions have thicknesses from 1.0 to 1.25 inches.

22. The railway vehicle coupler yoke of claim 21, wherein the openings in said strap portions are provided at a location of each strap portion that is between said positioning tabs and said draft gear seat wall.

23. A railway vehicle coupler yoke, comprising:

(a) a head portion at one end having a first wall and a second wall defining a front opening therebetween;

(b) a rear portion;

(c) two elongated strap portions, the strap portions spanning from the head portion to the rear portion, said rear portion joining said strap portions; and (d) a central pocket with two open sides formed by said two elongated strap portions;

(e) wherein each strap portion has at least two openings therein, and wherein each said opening provided in one strap portion opposes at least one of the openings provided in the other strap portion; and (f) wherein at least one opening in each strap portion is provided at a location of the strap portion that is spaced rearwardly from the head portion.

24. The railway vehicle coupler yoke of claim 23, wherein at least one of said at least two strap openings of each strap portion is provided in said head portion of the strap portion.

25. A railway vehicle coupler yoke, comprising:

(a) a head portion at one end having a first wall and a second wall defining a front opening therebetween;

(b) a rear portion;

(c) two elongated strap portions, the strap portions spanning from the head portion to the rear portion, said rear portion joining said strap portions; and (d) a central pocket with two open sides formed by said two elongated strap portions;

(e) a positioning tab provided on each of said first wall and said second wall;

(f) wherein each strap portion has at least one opening therein that is provided in said strap portion at a location between said rear portion and said positioning tabs; and (g) wherein at least a portion of each said at least one strap opening is located in a narrow elongated portion of said strap portion that spans substantially the length of the central pocket.

26. A railway vehicle coupler yoke, comprising:

(a) a head portion at one end having a first wall and a second wall defining a front opening therebetween;

(b) a rear portion;

(c) two elongated strap portions, the strap portions spanning from the head portion to the rear portion, said rear portion joining said strap portions; and (d) a central pocket with two open sides formed by said two elongated strap portions;

(e) wherein each elongated strap portion has at least one opening therein;

(f) wherein each elongated strap portion comprises a narrow portion, and wherein each narrow portion has an opposing pair of bordering portions that span along the central pocket and which border the opening in each strap portion;

(g) wherein said coupler yoke is configured as an F-type coupler yoke; and (h) wherein said head portion first wall is continuous with said top strap portion and forms an extension thereof, wherein said head portion second wall is continuous with said bottom strap portion and forms an extension thereof, wherein a pair of vertical walls join said first wall and said second wall at each side of said front opening, said first wall having an interior and an exterior, said second wall having an interior and an exterior, wherein at least one positioning tab is disposed on the interior of said first wall, wherein at least one positioning tab is disposed on the interior of said second wall, said at least one positioning tab on said first wall opposing said at least one positioning tab on said second wall, said positioning tabs extending from each respective first wall interior and second wall interior into the front opening.

27. The railway vehicle coupler yoke of claim 26, wherein the yoke is constructed from austempered ductile iron.

* * * * *